US011794320B2

(12) United States Patent
King et al.

(10) Patent No.: US 11,794,320 B2
(45) Date of Patent: Oct. 24, 2023

(54) SYSTEM AND METHOD FOR INDICATING TORQUE

(71) Applicant: Snap-on Incorporated, Kenosha, WI (US)

(72) Inventors: Jerry A. King, Hacienda Heights, CA (US); Nathan J. Lee, Escondido, CA (US); Donald J. Reynertson, Burr Ridge, IL (US)

(73) Assignee: Snap-on Incorporated, Kenosha, WI (US)

( * ) Notice: Subject to any disclaimer, the term of this patent is extended or adjusted under 35 U.S.C. 154(b) by 303 days.

(21) Appl. No.: 16/374,391

(22) Filed: Apr. 3, 2019

(65) Prior Publication Data

US 2019/0314962 A1 Oct. 17, 2019

Related U.S. Application Data

(60) Provisional application No. 62/657,364, filed on Apr. 13, 2018.

(51) Int. Cl.
*B25B 23/14* (2006.01)
*B25B 23/142* (2006.01)

(52) U.S. Cl.
CPC ..... *B25B 23/1405* (2013.01); *B25B 23/1425* (2013.01)

(58) Field of Classification Search
CPC . B25B 23/14; B25B 23/1405; B25B 23/1425; B25B 23/1456; B25B 23/147
See application file for complete search history.

(56) References Cited

U.S. PATENT DOCUMENTS

| | | | |
|---|---|---|---|
| 5,473,519 | A | 12/1995 | McCallops et al. |
| 6,007,693 | A | 12/1999 | Silveri |
| 6,517,295 | B2 | 2/2003 | Lin |
| 7,089,834 | B2 | 8/2006 | Reynertson et al. |
| 7,891,903 | B2 | 2/2011 | Klingenberg et al. |

(Continued)

FOREIGN PATENT DOCUMENTS

| | | |
|---|---|---|
| CA | 2849798 | 11/2014 |
| CN | 1884841 A | 12/2006 |

(Continued)

OTHER PUBLICATIONS

Translation of DE202009002124U1, retrieved from Espacenet on Apr. 9, 2021 (Year: 2009).*

(Continued)

*Primary Examiner* — Thomas Raymond Rodgers
(74) *Attorney, Agent, or Firm* — Seyfarth Shaw LLP

(57) ABSTRACT

The present invention relates to torque application tools, such as a torque screwdriver and ratchet tools, with one or more light indicators disposed in a ring shape around the tool. The light indicators are adapted to indicate amounts of torque values and/or angle values as the tool is used to tighten or install a work piece. For example, the light indicators may flash at a first flashing rate, when about 40% of a target torque or angle value is applied; flash at a second flashing rate (greater or faster than the first flashing rate) when about 60% of the target torque or angle value is applied; and illuminate at a solid state when about 80% of the target torque or angle value is applied.

16 Claims, 6 Drawing Sheets

(56) References Cited

U.S. PATENT DOCUMENTS

| | | | | |
|---|---|---|---|---|
| 9,328,915 | B2 | 5/2016 | Vanko et al. | |
| 9,464,893 | B2 | 10/2016 | Vanko et al. | |
| 9,707,670 | B2 | 7/2017 | Hita | |
| 9,715,812 | B2 | 7/2017 | Hita | |
| 2008/0127711 | A1 | 6/2008 | Farag | |
| 2009/0165608 | A1 | 7/2009 | Li | |
| 2009/0261737 | A1* | 10/2009 | Wright | F21V 23/0492 315/297 |
| 2013/0249700 | A1 | 9/2013 | Hsieh | |
| 2014/0069211 | A1 | 3/2014 | Backhaus et al. | |
| 2014/0331831 | A1* | 11/2014 | King | B25B 23/1425 81/479 |
| 2016/0221166 | A1 | 8/2016 | Hsieh | |
| 2016/0291257 | A1 | 10/2016 | Huang et al. | |
| 2016/0354889 | A1 | 12/2016 | Ely et al. | |
| 2017/0095912 | A1 | 4/2017 | Hsieh | |
| 2018/0000216 | A1 | 1/2018 | Gonzalez et al. | |

FOREIGN PATENT DOCUMENTS

| | | | | |
|---|---|---|---|---|
| CN | 2910483 | Y | 6/2007 | |
| CN | 102042896 | A | 5/2011 | |
| CN | 104139365 | A | 11/2014 | |
| CN | 104143010 | A | 11/2014 | |
| CN | 205465935 | U | 8/2016 | |
| CN | 205465938 | U | 8/2016 | |
| CN | 206450359 | U | 8/2017 | |
| DE | 102004043217 | A1 | 3/2005 | |
| DE | 202009002124 | U1 * | 4/2009 | B25B 23/1425 |
| DE | 202009002124 | U1 | 5/2009 | |
| EP | 3061574 | A1 | 8/2016 | |
| EP | 3461589 | A1 | 4/2019 | |
| JP | 2011088265 | | 5/2011 | |
| TW | 201341128 | A | 10/2013 | |
| TW | 201639669 | A | 11/2016 | |
| TW | I573671 | B | 3/2017 | |

OTHER PUBLICATIONS

United Kingdom Examination Report for Application No. GB1905011.1 dated Oct. 7, 2020, 5 pages.
Chinese Office Action for Application No. 201910295575.3 dated Aug. 18, 2020, 11 pages.
Taiwan Office Action for Application No. 108112983 dated Aug. 6, 2020, 11 pages.
United Kingdom Combined Search and Examination Report for Application No. GB1905011.1, dated Sep. 11, 2019, 6 pages.
Examination Report No. 1 for Application No. 20192025001 dated Mar. 6, 2020, 7 pages.
Canadian Office Action for Application No. 3,039,869 dated Apr. 23, 2020, 4 pages.
Office Action for Taiwan Application No. 108112983 dated Oct. 25, 2019, 6 pages.
Examination Report for Application No. GB1905011.1 dated May 29, 2020, 4 pages.
Examination Report No. 2 for Application No. 2019202501 dated Feb. 10, 2021, 5 pages.
Examination Report No. 3 for Application No. 2019202501 dated Feb. 26, 2021, 4 pages.
Canadian Office Action for Application No. 3,039,869 dated Feb. 23, 2021, 4 pages.
Taiwan Office Action for Application No. 11020217790 dated Mar. 10, 2021, 10 pages.
Combined Search and Examination Report for Application No. GB2101881.7 dated Mar. 25, 2021, 7 pages.
Chinese Office Action for Application No. 201910295575.3 dated Apr. 15, 2021, 8 pages.
Taiwan Office Action for corresponding TW Application No. 108112983, dated Aug. 23, 2021, 11 pages.
Chinese Office Action for corresponding CN Application No. 201910295575.3, dated Oct. 8, 2021, 7 pages.
Australian Office Action for corresponding AU Application No. 2021201471, dated Oct. 25, 2021, 4 pages.
Examination Report No. 2 for corresponding Application No. 2021201471 dated Aug. 13, 2022, 3 pages.

* cited by examiner

SYSTEM AND METHOD FOR INDICATING TORQUE

CROSS REFERENCE TO RELATED APPLICATIONS

The present application claims priority to U.S. Provisional Patent Application No. 62/657,364, filed on Apr. 13, 2018, entitled System and Method for Indicating Torque, the contents of which are incorporated by reference herein in their entirety.

TECHNICAL FIELD OF THE INVENTION

The present invention relates generally to torque application tools. More particularly, the present invention relates to torque application tools adapted to indicate torque and angle target values.

BACKGROUND OF THE INVENTION

Typical torque application tools, such as screwdrivers or ratchet tools, may be used to apply torque to a fastener. Some mechanical and electronic torque application tools have indicators that indicate an approaching and/or achieved target torque value to a user. However, these indicators are limited, and are typically audible (such as beeps) or a display of numbers on a display screen. Audible indicators can be difficult to hear in loud environments. Additionally, a display on a display screen can be difficult to see, because the display screen may be obstructed by a hand of the user when the torque screwdriver is being used.

SUMMARY OF THE INVENTION

The present invention relates broadly to torque application tools, such as a torque screwdriver, with one or more light indicators disposed in a ring shape around the tool. The light indicators may be positioned proximal to a head of the tool, which allows for unobstructed viewing by a user. The light indicators are adapted to indicate amounts of torque and/or angle applied to a work piece, such as a fastener. For example, the light indicators may flash at a first flashing rate when about 40% of a target torque or angle value is applied; flash at a second flashing rate (greater or faster than the first flashing rate) when about 60% of the target torque or angle value is applied; and illuminate at a solid state when about 80% of the target torque or angle value is applied.

In an embodiment, a tool adapted to apply torque to a work piece is disclosed. The tool includes a first indicator adapted to illuminate at a first flashing rate when about 40% of a target torque or angle value is applied to the work piece; illuminate at a second flashing rate, greater than the first flashing rate, when about 60% of the target torque or angle value is applied to the work piece; and illuminate at a solid state when about 80% of the target torque or angle value is applied to the work piece.

In another embodiment, a method for indicating an amount of torque applied to a work piece is disclosed. The method includes illuminating a first indicator at a first flashing rate when about 40% of a target torque or angle value is applied to the work piece; illuminating the first indicator at a second flashing rate, greater than the first flashing rate, when about 60% of the target torque or angle value is applied to the work piece; and illuminating the first indicator at a solid state when about 80% of the target torque or angle value is applied to the work piece.

In another embodiment, a tool adapted to apply torque to a work piece is disclosed. The tool includes a first indicator adapted to illuminate at a first flashing rate when about 40% of a target torque or angle value is applied to the work piece; illuminate at a second flashing rate, greater than the first flashing rate, when about 60% of the target torque or angle value is applied to the work piece; and illuminate at a solid state when about 80% of the target torque or angle value is applied to the work piece. The tool further includes a second indicator adapted to illuminate at a solid state when the target torque or angle value is applied to the work piece. The tool also includes a third indicator adapted to illuminate at a solid state when an amount greater than the target torque or angle value is applied to the work piece.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages, should be readily understood and appreciated.

DETAILED DESCRIPTION

Figure 1:
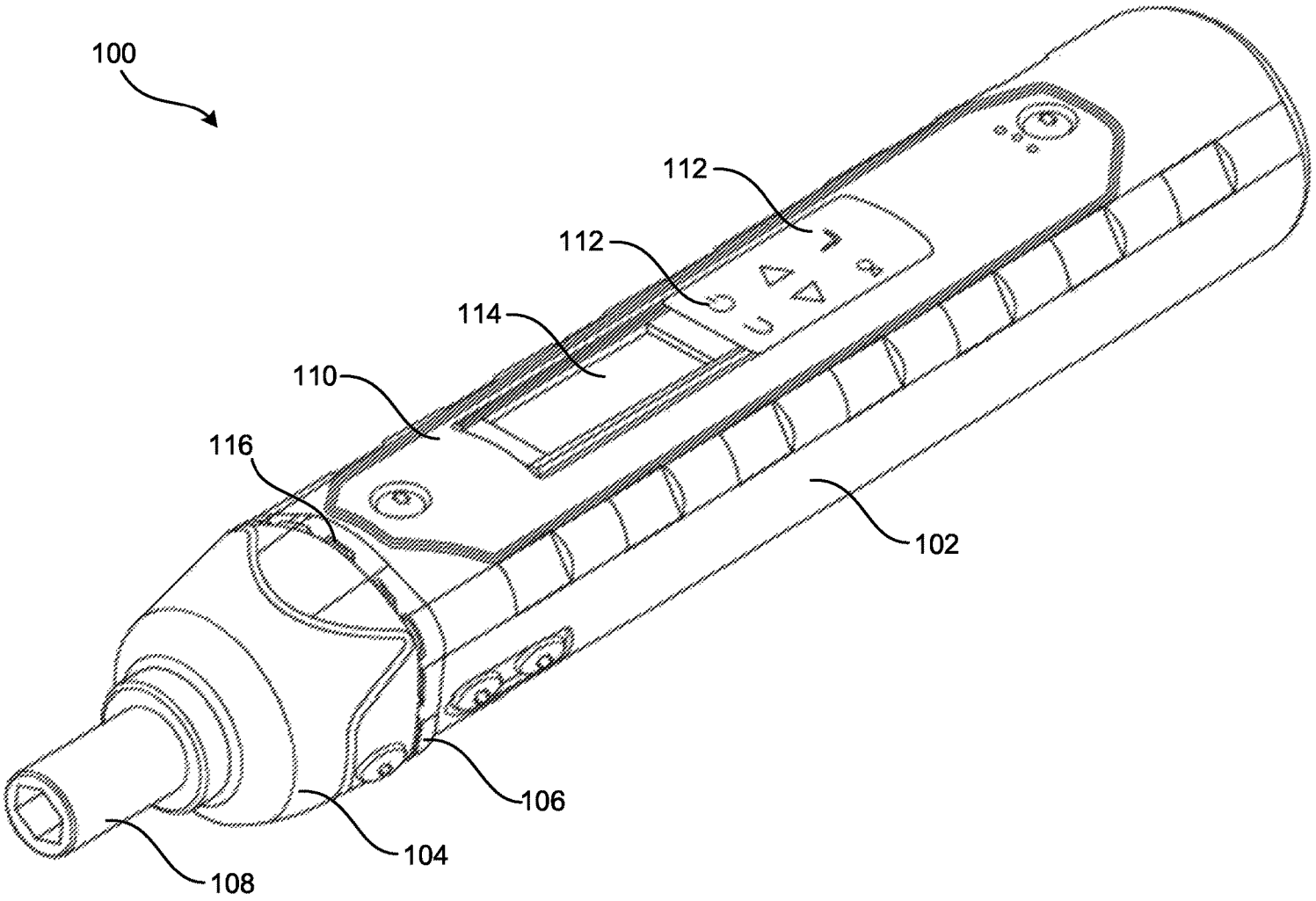
FIG. 1 is a perspective view of a torque application tool according to an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention relates broadly to torque application tools, such as a torque screwdriver, with one or more light indicators disposed in a ring shape around the tool. It will be appreciated that while the present invention is shown as being an in-line screwdriver or ratcheting tool for exemplary purposes, the present invention is not so limited, and can be used with any type of torque application tool. The light indicators may be positioned proximal to a head of the tool, which allows for unobstructed viewing by a user. The light indicators are adapted to indicate amounts of torque values and/or angular rotation as the tool is used to tighten or install a work piece, such as a fastener. For example, the light indicators may flash at a first flashing rate, when about 40% of a target torque or angle value is applied; flash at a second flashing rate (greater or faster than the first flashing rate) when about 60% of the target torque or angle value is applied; and illuminate at a solid state when about 80% of the target torque or angle value is applied.

Figure 2:
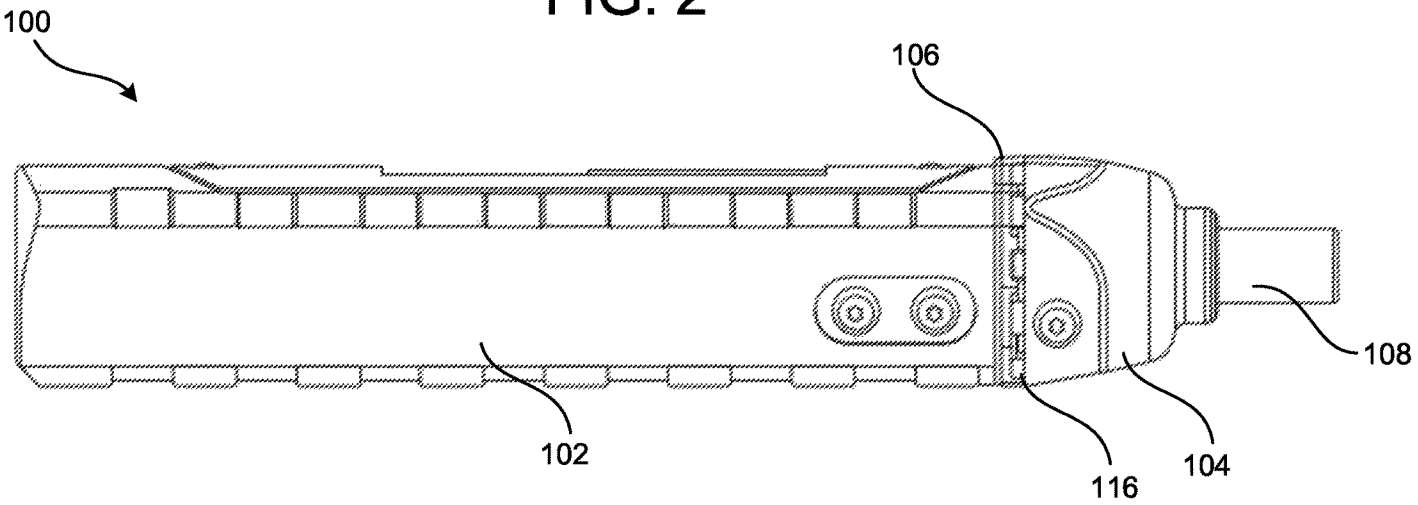
FIGS. 2 and 3 are first and second side views of the torque application tool of FIG. 1, according to an embodiment of the present invention.
Figure 3:
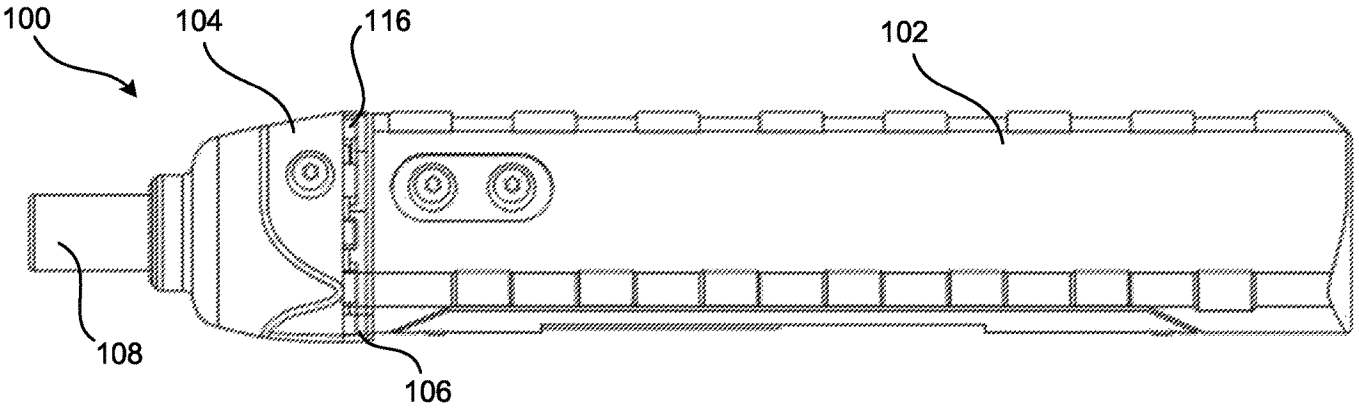

Referring to FIGS. 1-3, a torque application tool 100, such as a torque screwdriver or ratcheting tool, is illustrated. The tool 100 includes a body portion 102 (also referred to as a body 102), a head portion 104 (also referred to as a head 104) coupled to the body 102, a light ring 106 disposed between the head 104 and the body 102, and a drive 108 extending from the head 104. The tool 100 is adapted to apply torque to a work piece, such as a fastener, via an adapter, bit, or socket coupled to the drive 108, such as a bi-directional ratcheting square or hexagonal drive. As illustrated, the drive 108 is a "female" connector designed to receive a male counterpart. However, the drive 108 may be a "male" connector designed to fit into or penetrate a female counterpart. The drive may also be structured to directly engage a work piece without coupling to an adapter, bit, or socket.

The body 102 may also function as a handle, and be gripped by a user to apply torque to the work piece. Accordingly, the body 102 may include a textured grip to improve a user's grasp of the tool 100 during torquing operations. The body 102 may also house a control unit 110 of the tool 100. The control unit 110 may include a user interface, such as a user interface comprising at least one button 112 and a display screen 114. The display screen 114 may optionally be touch-sensitive, with software or firmware executed by a processor or controller of the control unit 110 providing virtual on-screen controls. Instructions and other information can be input directly into the tool 100 via the user interface. During torque application operations, the display 114 may display information, such as, for example, torque and/or angle information. As will be discussed below, the body 102 and/or head 104 may also house one or more sensors used to sense and measure the amount of torque applied to a work piece via the drive 108, and the amount of angle of rotation applied to the work piece via the drive 108. The tool 100 may also include an orientation sensor to determine the angle of a longitudinal axis of the body 102 relative to "down" (that is, relative to the force of gravity).

As described below, the tool 100 can measure, record, and display torque and angle data in substantially real time during torquing operations, as well as transmit that data in real time to an external device (such as, an external computing device, mobile device, etc.). In the context of the present invention, "real time" means "without significant delay" (e.g., measurement and processing delays not exceeding one second per data sample). Torque application and angle data may be logged and stored with a time index by the tool 100 and/or a software application on the external device.

The light ring 106 may include one or more illuminating indicators 116, such as light emitting diodes (LEDs). In an embodiment, the LEDs are multiple color LEDs. The indicators 116 are equally spaced 360 degrees around a longitudinal axis of the tool 100, and between the head 104 and the body 102. This allows one or more of the indicators 116 to be visible to the user during a torquing operation. For example, during a torquing operation, the user may grasp the body 102, and the user's hand may obstruct the display screen 114. However, the light ring 106 remains unobstructed by the user's hand since the light ring 106 is proximal to the head 104 between the head 104 and the body 102. In some embodiments, the light ring 106 may be angled or oriented to face in a direction towards a rear of the body 102 (i.e., away from the drive 108), and thereby towards the user.

As mentioned, the indicators 116 may be multiple color LEDs. In this respect, the indicators 116 may include first indicators (such as indicators 116*a* illustrated in FIG. 4) adapted to illuminate yellow, second indicators (such as indicators 116*b* illustrated in FIG. 4) adapted to illuminate green, and third indicators (such as indicators 116*c* illustrated in FIG. 4) adapted to illuminate red, for example. It should be appreciated that different color indicators may also be used.

The different colored first, second, and third indicators are used to indicate to the user, that the amount of applied torque and/or angular rotation is approaching a target torque and/or angle value, the target torque and/or angle value has been reached, and when an upper limit of the target torque and/or angle value has been exceeded. As described, the light ring 106 (including the indicators 116) are proximal to a head 104 of the tool 100 so the indicators 116 are not obstructed by the user's hand when using the tool 100. The indicators 116 are also placed in a ring pattern allowing 360 degrees of viewing during rotation and/or use of the tool 100.

In an embodiment, the indicators 116 indicate amounts of applied torque and/or angle as a percentage of the target torque and/or angle values. For example, the first indicators (illustrated as first LEDs 116*a* in FIG. 4) are used to indicate increasing amounts of applied torque and/or angle. The first indicators flash at a first flashing rate when the amount of applied torque and/or angle is about 40% of the target torque and/or angle values. The first indicators flash at a second flashing rate (greater or faster than the first flashing rate) when the amount of applied torque and/or angle is about 60% of the target torque and/or angle values. The first indicators are illuminated in a solid state (i.e., are illuminated and do not flash) when the amount of applied torque and/or angle is about 80% of the target torque and/or angle values. This sequencing of the first indicators provides an indication of the rate at which the amount or torque and/or angle is being applied in reference to the target torque and/or angle values, and allows the user to adjust the rate as the target torque and/or angle value approaches to avoid over torquing or over rotating.

In an embodiment, the second indicators (illustrated as LEDs 116*b* in FIG. 4) are illuminated in a solid state (i.e., are illuminated and do not flash) when the amount of applied torque and/or angle reaches the target torque and/or angle values. The green color of the second indicators provides the user with a positive indication the target torque and/or angle value has been reached, following the sequence of the first indicators. When the second indicators are illuminated, the first indicators turn off.

In an embodiment, the third indicators (illustrated as LEDs 116*c* in FIG. 4) are illuminated in a solid state (i.e., are illuminated and do not flash) when the amount of applied torque and/or angle reaches an over-limit torque and/or angle value. The over-limit value is the target torque and/or angle value plus a tolerance value, which may be set via a torque/angle tolerance setting. The red color of the third indicators differentiate them from the yellow and green colors of the respective first and second indicators. The second indicators also turn off when the third indicators are illuminated. The red color of the third indicators may also indicate to the user that corrective action may be necessary.

Other means of indicating a progress toward the target torque and/or angle can be implemented without departing from the spirit and scope of the present application. For example, audible indications can be activated (using the speaker/transduce 126 illustrated in FIG. 4), and/or tactile indications can be activated (using the haptic vibrator 128 illustrated in FIG. 4).

Figure 4:
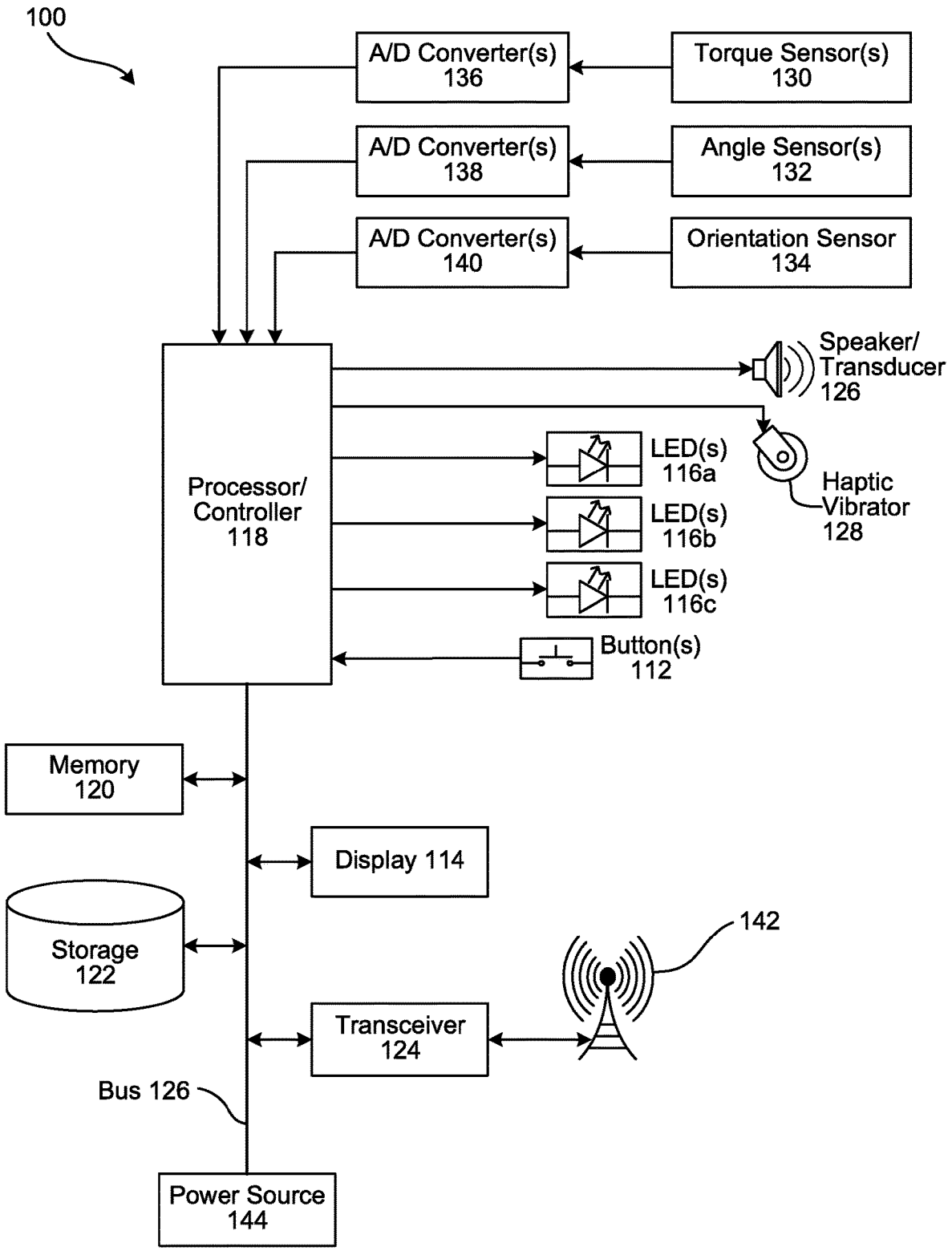
FIG. 4 is an exemplary block diagram conceptually illustrating example components of the torque application tool of FIG. 1, according to an embodiment of the present invention.

FIG. 4 is an exemplary block diagram conceptually illustrating examples of the components of the tool 100 of FIG. 1. The tool 100 may include one or more controllers/processors 118, a memory 120, non-volatile storage 122, and a wireless communications transceiver 124. Each controller/processor 118 may include a central processing unit (CPU) for processing data and computer-readable instructions. The processor/controller 118 retrieves instructions from data storage 122 via a bus 126, using the memory 120 for runtime temporary storage of instructions and data. The memory 120 may include volatile and/or nonvolatile random access memory (RAM). While components are illustrated in FIG. 4 as being connected via the bus 126, components may also be connected to other components in addition to (or instead of) being connected to other components via the bus 126.

Data storage 122 stores the instructions, including instructions to manage illumination of the indicators 116 and communication with the external device. The data storage component 122 may include one-or-more types non-volatile solid-state storage, such as flash memory, read-only memory (ROM), magnetoresistive RAM (MRAM), phase-change memory, etc. The tool 100 may also include an input/output interface to connect to removable or external non-volatile memory and/or storage (such as a removable memory card, memory key drive, networked storage, etc.). Such an input/output interface may be a wired or embedded interface (not illustrated) and/or may comprise the wireless communications transceiver 124.

Computer instructions for operating the tool 100 and its various components may be executed by the controller/processor 118, using the memory 120 as temporary "working" storage at runtime. The computer instructions may be stored in a non-transitory manner in non-volatile memory 120, storage 122, or an external device. Alternatively, some-or-all of the executable instructions may be embedded in hardware or firmware in addition to or instead of software.

The tool 100 may include multiple input and output interfaces. These interfaces may include the radio transceiver 124, one-or-more buttons 112, one-or-more light-emitting diodes LEDs 116 (including first indicators 116*a*, second indicators 116*b*, and third indicators 116*c*), a speaker or audio transducer 126, a haptics vibrator 128, one-or-more torque sensors 130, one-or-more angle sensors 132, and an orientation sensor 134. The torque sensor 130 may include, for example, one-or-more of a torque transducer, a strain gauge, a magnetoelastic torque sensor, and a surface acoustic wave (SAW) sensor. The angle sensors 132 may comprise, for example, one-or-more of a rotational angle sensor and an electronic gyroscope (such as a two-or-three axes gyroscope). The orientation sensor 134 may comprise a three-axes electronic accelerometer or gravity sensor to determine the orientation of the longitudinal axis of the tool 100 relative to "down."

Depending on the type of torque sensor 130 used, analog-to-digital (A/D) converters 136 may receive analog signals from the torque sensor 130, outputting digital signals to the processor/controller 118. Likewise, A/D converters 138 may receive analog signals from the angle sensor 132, and A/D converters 140 may receive analog signals from the orientation sensor 134, outputting digital signals to the processor/controller 118. The A/D converters 136/138/140 may be discrete, integrated with/in the processor/controller 118, or integrated with/in their respective sensors 136/138/140.

The number of, and need for, the A/D converters 136/138/140 is dependent on the technology used for each sensor 130/132/134. Multiple A/D converters may be provided to accommodate as many signals as needed, such as if the angle sensor 132 provides analog outputs for a plurality of gyroscope axes, or if the orientation sensor 134 provides analog outputs for a plurality of accelerometer axes. Signal conditioning electronics (not illustrated) may also be included as standalone circuitry, integrated with/in the processor/controller 118, or integrated with/in the respective sensors 130/132/134, to convert non-linear outputs generated by a component of a sensor 130/132/134 into a linear signal.

Instructions executed by the processor/controller 118 receive data from the sensors 130/132/134, such as torque and angle values. From that data, the processor/controller 118 may determine various information, such as the duration that torque has been or should be applied to a work piece.

The sensor data and information can be logged in substantially real time or at a predetermined sampling rate and stored in the memory 120 and/or storage 122. The sensor data and information may also be transmitted to the external device via a communication link 142 (which may include an antenna) for further analysis and review. For example, the communication link 142 may use a protocol such as Wi-Fi Direct, or a personal area network (PAN) protocol such as Bluetooth, Bluetooth Smart (also known as Bluetooth low energy), wireless USB, or ZigBee (IEEE 802.15.4). The communication link 142 may be a wireless local area network (WLAN) link such as a flavor of Wi-Fi, or a cellular communications data protocol associated with mobile broadband, LTE, GSM, CDMA, WiMAX, High Speed Packet Access (HSPA), Universal Mobile Telecommunications System (UMTS), etc.

"Data" is/are values that are processed to make them meaningful or useful "information." However, as used herein, the terms data and information should be interpreted to be interchangeable, with data including information and information including data. For example, where data is stored, transmitted, received, or output, that may include data, information, or a combination thereof.

The radio transceiver 124 comprises a transmitter, a receiver, and associated encoders, modulators, demodulators, and decoders. The transceiver 124 manages the radio communication links, establishing the communications link 142 with the external device via one-or-more antennas embedded in the tool 100, enabling bidirectional communication between the processor/controller 118 and the external device. The communications link 142 may be a direct link between the tool 100 and the external device, or may be an indirect link through one-or-more intermediate components, such as via a Wi-Fi router or mesh connection (not illustrated).

The tool 100 also includes a power source 144 to power the processor/controller 118, the bus 126, and other electronic components. For example, the power source 144 may be one-or-more batteries arranged in the body 102. However, the power source 144 is not limited to batteries, and other technologies may be used such as fuel cells. The tool 100 may also include components to recharge the power source 144, such as organic or polymer photovoltaic cells arranged along the tool 100, and/or an interface by which to receive an external charge, such as a Universal Serial Bus (USB) port or an inductive pick-up, along with associated charging-control electronics.

The display 114 may be used by software/firmware executed by the processor/controller 118 to display information for the user to view and interpret. Such information may be formatted as text, graphics, or a combination thereof. The display 114 may also be used to provide feedback when information is entered into tool 100 (for example, via the buttons 112 and/or a touch-sensitive interface integrated with the display 114 itself). The display 114 may be a liquid crystal display (LCD) display, an organic light emitting diode (OLED) display, an electronic paper display, or any kind of black-and-white or color display that has suitable power-consumption requirements and volume to facilitate integration into the tool 100.

Figure 5:
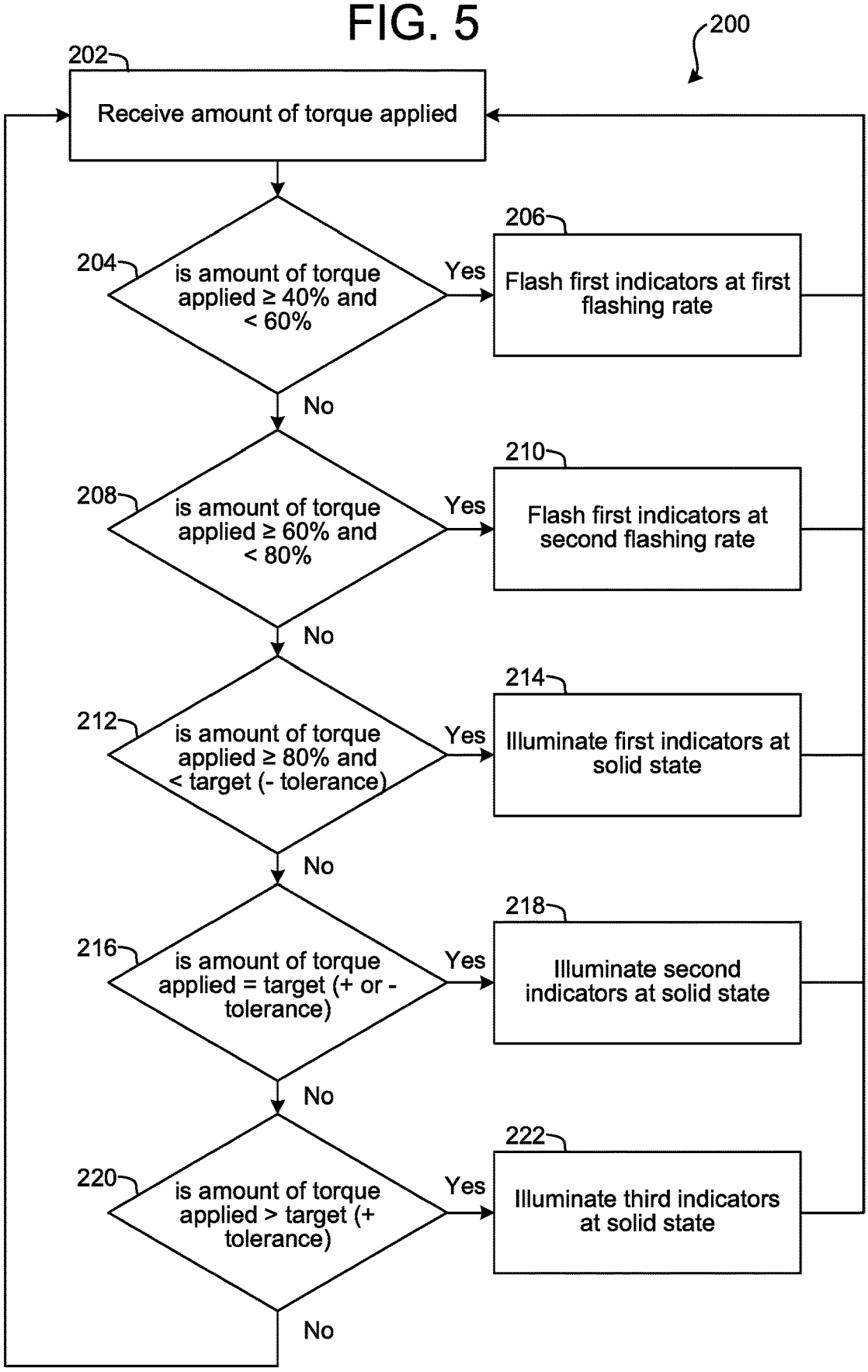
FIG. 5 is an exemplary process flow diagram illustrating operations of illuminating indicators of the torque application tool of FIG. 1, according to an embodiment of the present invention.

FIG. 5 is an exemplary process flow diagram illustrating a method 200 of illuminating indicators of the torque application tool of FIG. 1, based on torque values. The steps of the method 200 may be performed using the components of the tool 100 illustrated in FIG. 4. For example, the processor/controller 118 may receive torque data, such as a value of an amount of torque applied to a work piece measured by and received from the torque sensor 130, illustrated as block 202. The processor/controller 118 may receive the torque data in real time or at predetermined intervals during a torquing operation. At block 204, the processor/controller 118 determines whether the measured amount of torque applied to the work piece is greater than or equal to 40% and less than 60% of the target torque value for the torquing operation (i.e., the amount of torque applied to the work piece is between about 40% and 60% of the target torque value). If YES, then the processor/controller 118 causes the first indicators 116*a* to flash at a first flashing rate, illustrated as block 206, and the method 200 proceeds back to block 202. If NO, the method 200 proceeds to decision block 208.

At block 208, the processor/controller 118 determines whether the measured amount of torque applied to the work piece is greater than or equal to 60% and less than 80% of the target torque value for the torquing operation (i.e., the amount of torque applied to the work piece is between about 60% and 80% of the target torque value). If YES, then the processor/controller 118 causes the first indicators 116*a* to flash at a second flashing rate (that is greater or faster than the first flashing rate), illustrated as block 210, and the method 200 proceeds back to block 202. If NO, the method 200 proceeds to decision block 212.

At block 212, the processor/controller 118 determines whether the measured amount of torque applied to the work piece is greater than or equal to 80% of the target torque value for the torquing operation and less than the target torque value minus a tolerance value, such as about 0% to about 10% (i.e., the amount of torque applied to the work piece is about 80%, but has not yet reached the target torque value). If YES, then the processor/controller 118 causes the first indicators 116*a* to illuminate is a solid state (i.e., remain illuminated without flashing), illustrated as block 214, and the method 200 proceeds back to block 202. If NO, the method 200 proceeds to decision block 216.

At block 216, the processor/controller 118 determines whether the measured amount of torque applied to the work piece is about equal to the target torque value for the torquing operation plus or minus the tolerance value. If YES, then the processor/controller 118 causes the second indicators 116*b* to illuminate is a solid state (i.e., remain illuminated without flashing), illustrated as block 218. In this respect, the second indictors indicate that the target torque value for the torquing operation has been reached. However, if NO, the method 200 proceeds to decision block 220.

At block 220, the processor/controller 118 determines whether the measured amount of torque applied to the work piece is greater than the target torque value for the torquing operation plus the tolerance value. If YES, then the processor/controller 118 causes the third indicators 116*c* to illuminate is a solid state (i.e., remain illuminated without flashing), illustrated as block 222. In this respect, the third indictors indicate that the target torque value for the torquing operation has been past, and an over-limit condition has occurred. However, if NO, the method 200 proceeds back to block 202.

In accordance with the method 200 and during a torquing operation, the tool 100 causes the indicators of the light ring 106 to flash yellow when the measured amount of torque applied to the work piece is about 40% of the target torque value, flash yellow faster when the measured amount of torque applied to the work piece is about 60% of the target torque value, illuminate yellow when the measured amount of torque applied to the work piece is about 80% of the target torque value, and illuminate green when the amount of torque applied to the work piece has reached the target torque value.

Figure 6:
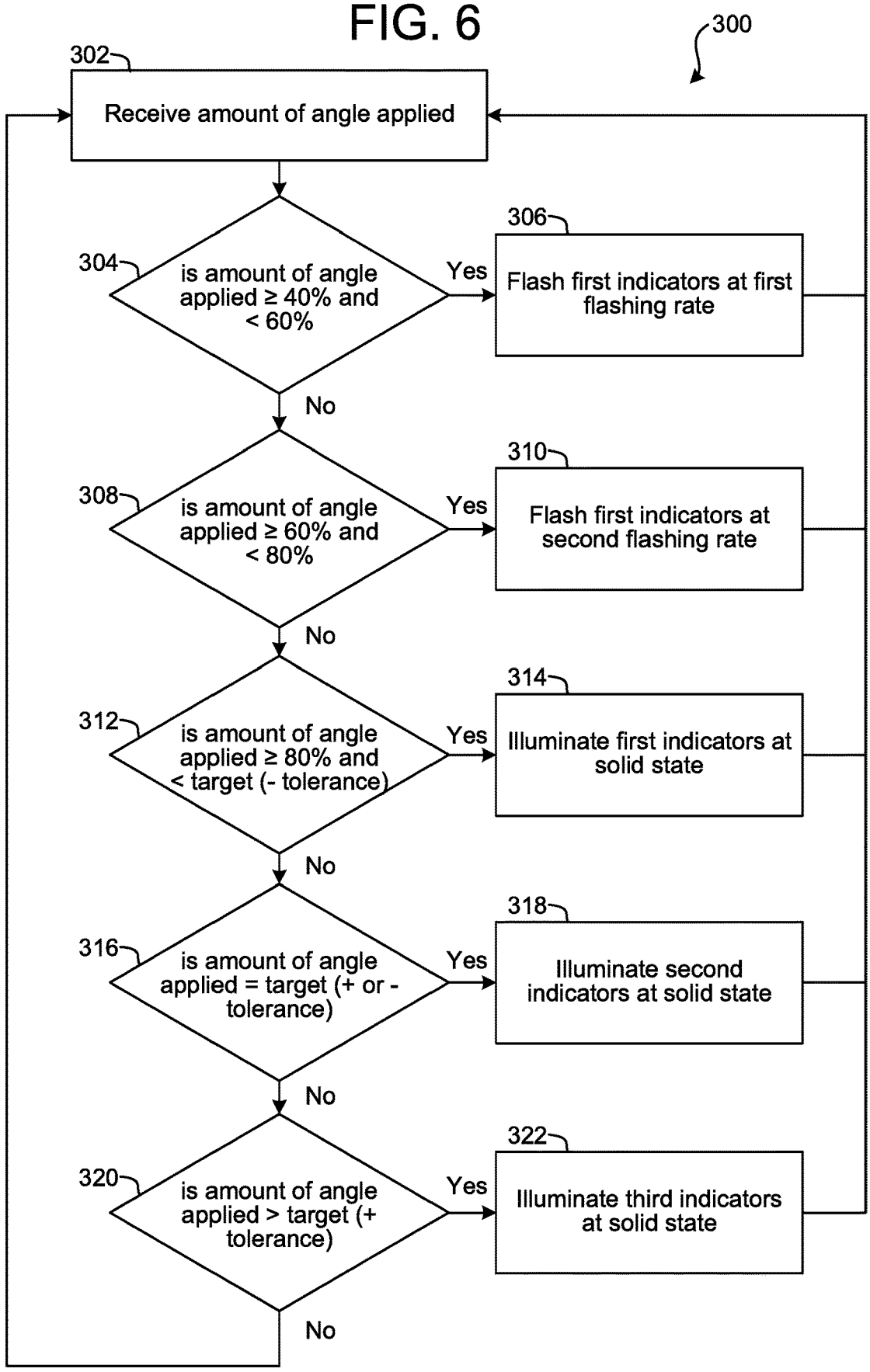
FIG. 6 is another exemplary process flow diagram illustrating operations of illuminating indicators of the torque application tool of FIG. 1, according to an embodiment of the present invention.

A similar method may be applied to measurements of angle. FIG. 6 is an exemplary process flow diagram illustrating a method 300 of illuminating indicators of the torque application tool of FIG. 1, based on angle values. The steps of the method 300 may be performed using the components of the tool 100 illustrated in FIG. 4. For example, the processor/controller 118 may receive angle data, such as a value of an amount of angular rotation applied to a work piece measured by and received from the angle sensor 132, illustrated as block 302. The processor/controller 118 may receive the angle data in real time or at predetermined intervals during a torquing operation. At block 304, the processor/controller 118 determines whether the measured amount of angular rotation applied to the work piece is greater than or equal to 40% and less than 60% of the target angle value for the torquing operation (i.e., the amount of angular rotation applied to the work piece is between about 40% and 60% of the target angle value). If YES, then the processor/controller 118 causes the first indicators 116*a* to flash at a first flashing rate, illustrated as block 306, and the method 300 proceeds back to block 302. If NO, the method 300 proceeds to decision block 308.

At block 308, the processor/controller 118 determines whether the measured amount of angular rotation applied to the work piece is greater than or equal to 60% and less than 80% of the target angle value for the torquing operation (i.e., the amount of angular rotation applied to the work piece is between about 60% and 80% of the target angle value). If YES, then the processor/controller 118 causes the first indicators 116*a* to flash at a second flashing rate (that is greater or faster than the first flashing rate), illustrated as block 310, and the method 300 proceeds back to block 302. If NO, the method 300 proceeds to decision block 312.

At block 312, the processor/controller 118 determines whether the measured amount of angular rotation applied to the work piece is greater than or equal to 80% of the target angle value for the torquing operation and less than the target angle value minus a tolerance value, such as about 0% to about 10% (i.e., the amount of angular rotation applied to the work piece is about 80%, but has not yet reached the target angle value). If YES, then the processor/controller 118 causes the first indicators 116*a* to illuminate is a solid state (i.e., remain illuminated without flashing), illustrated as block 314, and the method 300 proceeds back to block 302. If NO, the method 300 proceeds to decision block 316.

At block 316, the processor/controller 118 determines whether the measured amount of angular rotation applied to the work piece is about equal to the target angle value for the torquing operation plus or minus the tolerance value. If YES, then the processor/controller 118 causes the second indicators 116*b* to illuminate is a solid state (i.e., remain illuminated without flashing), illustrated as block 318. In this respect, the second indictors indicate that the target angle value for the torquing operation has been reached. However, if NO, the method 300 proceeds to decision block 320.

At block 320, the processor/controller 118 determines whether the measured amount of angular rotation applied to the work piece is greater than the target angle value for the torquing operation plus the tolerance value. If YES, then the processor/controller 118 causes the third indicators 116*c* to illuminate is a solid state (i.e., remain illuminated without flashing), illustrated as block 322. In this respect, the third indictors indicate that the target angle value for the torquing operation has been past, and an over-limit condition has occurred. However, if NO, the method 300 proceeds back to block 302.

In accordance with the method 300 and during a torquing operation, the tool 100 causes the indicators of the light ring 106 to flash yellow when the measured amount of angular rotation applied to the work piece is about 40% of the target angle value, flash yellow faster when the measured amount of angular rotation applied to the work piece is about 60% of the target angle value, illuminate yellow when the measured amount of angular rotation applied to the work piece is about 80% of the target angle value, and illuminate green when the measured amount of angular rotation applied to the work piece has reached the target angle value.

The methods 200 and 300 may be applied independently, in succession, or simultaneously. For example, a torquing operation may include applying a target torque value to a work piece, and once the target torque value is reached, applying a target angle to the work piece. Accordingly, the method 200 may be applied, and then the method 300 may be applied in succession.

Figure 7:
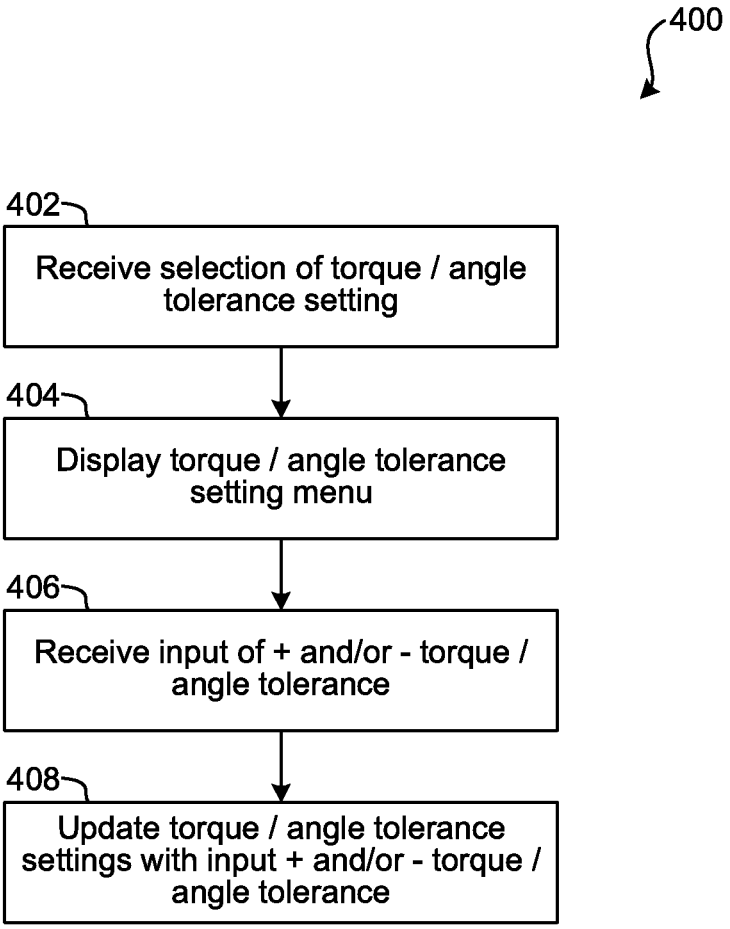
FIG. 7 is an exemplary process flow diagram illustrating operations of setting a tolerance range of the torque application tool of FIG. 1, according to an embodiment of the present invention.

The tolerance value may also be set by the user prior to a torquing operation. FIG. 7 is an exemplary process flow diagram illustrating a method 400 of setting a tolerance range of the torque application tool of FIG. 1. The steps of the method 400 may be performed using the components of the tool 100 illustrated in FIGS. 1 and 4. For example, a user may input a selection of a torque or angle tolerance setting option provided on the display 114 by activating one or more buttons 112, and the processor/controller 118 may receive the selection of a torque or angle tolerance setting option, illustrated as block 402. The processor/controller 118 may then cause display of a torque or angle tolerance setting menu on the display 114, illustrated as block 404.

The user may then select or input a tolerance amount or range using the buttons 112. For example, the user may input a plus or minus tolerance range for the target torque value, a tolerance for the target angle value, and/or a tolerance range to be applied to both the target torque and angle values. In an example, the use may input a plus tolerance range of about 0% to about 10% of the target torque and/or angle value, and a minus tolerance range of about 0% to about 10% of the target torque and/or angle value. This allows for a user to set a narrow or wider acceptable target torque and/or angle range.

The processor/controller receives the tolerance amount or range, illustrated as block 406, and updates the torque or angle tolerance settings with the tolerance amount or range, illustrated as block 408. The updated torque or angle tolerance settings may then be used in a torquing operation.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object. As used herein, the term "a" or "one" may include one or more items unless specifically stated otherwise.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A tool having a handle portion with opposing first and second ends, a head portion proximal to the first end, and a drive extending from the head portion, wherein the drive is adapted to apply torque to a work piece that has a target amount of torque or angle that is to be applied to the work piece, the tool comprising:

a display coupled to the handle portion between the first and second ends;

a sensor adapted to measure an amount of torque or angle applied to the work piece by the drive; and a light ring circumferentially disposed around a longitudinal axis of the tool between the display and the head portion, and including first, second, and third indicators that are oriented to face in a direction away from the head portion and towards the handle portion, wherein: the first indicator is adapted to:

illuminate with a first flashing rate when a first measured amount of torque or angle is applied to the work piece by the drive, wherein the first measured amount is about 40% of the respective target amount of torque or angle that is to be applied to the work piece;

change from the first flashing rate to illuminate with a second flashing rate that is greater than the first flashing rate when a second measured amount of torque or angle is applied to the work piece by the drive, wherein the second measured amount is about 60% of the respective target amount of torque or angle that is to be applied to the work piece, and the first indicator is illuminated with the first flashing rate until the second measured amount of torque or angle is applied to the work piece; and change from the second flashing rate to illuminate with a when a third measured amount of torque or angle is applied to the work piece by the drive, wherein the third measured amount is about 80% of the respective target amount of torque or angle that is to be applied to the work piece, and the first indicator is illuminated with the second flashing rate until the third measured amount of torque or angle is applied to the work piece;

the second indicator is adapted to illuminate when a fourth measured amount of torque or angle applied to the work piece by the drive is about equal to the target amount of torque or angle that is to be applied to the work piece; and the third indicator is adapted to illuminate when a fifth measured amount of torque or angle applied to the work piece by the drive is greater than the target amount of torque or angle that is to be applied to the work piece.

2. The tool of claim 1, wherein the second indicator is adapted to illuminate with a solid state.

3. The tool of claim 2, wherein the third indicator is adapted to illuminate with a solid state.

4. The tool of claim 1, wherein the tool is an in-line type tool.

5. The tool of claim 1, wherein each of the first, second and third indicators includes more than one indicator arranged in a ring type shape around the longitudinal axis of the tool.

6. The tool of claim 1, wherein the first indicator is adapted to illuminate with a first color.

7. The tool of claim 6, wherein the second indicator is adapted to illuminate with a second color different than the first color.

8. The tool of claim 7, wherein the third indicator is adapted to illuminate with a third color different than the first and second colors.

9. The tool of claim 8, wherein the first color is a yellow color, the second color is a green color, and the third color is a red color.

10. The tool of claim 7, wherein the first color is a yellow color and the second color is a green color.

11. The tool of claim 6, wherein the first color is a yellow color.

12. The tool of claim 1, wherein the tool is an in-line ratcheting tool.

13. The tool of claim 1, wherein the tool is a torque screwdriver.

14. A method for indicating an amount of torque applied by a tool to a work piece that has a target amount of torque or angle that is to be applied to the work piece, wherein the tool includes a handle portion with opposing first and second ends, a head portion proximal to the first end, a drive extending from the head portion, and a display coupled to the handle portion between the first and second ends, the method comprising:

measuring the amount of torque or angle applied to the work piece;

illuminating a first indicator of a plurality of indicators of a light ring at a first flashing rate when the measured amount of torque or angle is about 40% of the respective target amount of torque or angle that is to be applied to the work piece, wherein the light ring is circumferentially disposed around a longitudinal axis of the tool between the display and the head portion, and the indicators are oriented to face in a direction away from the head portion and towards the handle portion;

illuminating the first indicator at a second flashing rate, greater than the first flashing rate, when the measured amount of torque or angle is about 60% of the respective target amount of torque or that is to be applied to the work piece illuminating the first indicator at a solid state when the measured amount of torque or angle is about 80% of the respective target amount of torque or angle that is to be applied to the work piece;

illuminating a second indicator of the plurality of indicators of the light ring when the measured amount of torque or angle is about equal to the respective target amount of torque or angle that is to be applied to the work piece; and illuminating a third indicator of the plurality of indicators of the light ring when the measured amount of torque or angle is greater than the respective target amount of torque or angle that is to be applied to the work piece.

15. The method of claim 14, wherein illuminating the second indicator includes illuminating the second indicator at a solid state.

16. The method of claim 14 wherein illuminating the third indicator includes illuminating the third indicator at a solid state.

* * * * *